United States Patent [19]

Harris et al.

[11] Patent Number: 4,715,083

[45] Date of Patent: Dec. 29, 1987

[54] VACUUM CLEANER TOOL STORAGE

[75] Inventors: Frank R. Harris; Gordon E. Laing, both of Anderson, S.C.

[73] Assignee: The Singer Company, Stamford, Conn.

[21] Appl. No.: 912,742

[22] Filed: Sep. 29, 1986

[51] Int. Cl.[4] ..... A47L 9/00

[52] U.S. Cl. ..... 15/323

[58] Field of Search ..... 15/323

[56] References Cited

U.S. PATENT DOCUMENTS

| | | | |
|---|---|---|---|
| 3,029,462 | 4/1962 | Tamarin | 15/323 |
| 3,253,294 | 5/1966 | Waters | 15/323 |
| 4,467,493 | 8/1984 | Buchtel | 15/323 |
| 4,642,840 | 2/1987 | Jacob et al. | 15/323 |

FOREIGN PATENT DOCUMENTS

| | | | |
|---|---|---|---|
| 6713604 | 4/1968 | Netherlands | 15/323 |
| 8202745 | 2/1983 | Netherlands | 15/323 |

*Primary Examiner*—Chris K. Moore

*Attorney, Agent, or Firm*—David L. Davis

[57] ABSTRACT

Vacuum cleaner attachment storage in recesses beneath a floor supported vacuum cleaner housing with pivoted latch elements for attachment retention which does not require increased cleaner housing dimensions or a cover for the stored attachments, either to conceal the stored attachments or to prevent dirt collection in the storage recesses.

3 Claims, 5 Drawing Figures

VACUUM CLEANER TOOL STORAGE

BACKGROUND OF THE INVENTION

1. Field of the Invention

This invention relates to vacuum cleaners and, more particularly, to the storage in association with a vacuum cleaner of cleaning tools such as nozzles, brushes, and the like.

2. Description of the Prior Art

U.S. Pat. Nos. 2,573,091, Oct. 30, 1951 of Brown; 2,608,709, Sept. 2, 1952 of Benjamin; and 3,253,294, May 31, 1966 of Waters disclose arrangements for storing tools within a compartment in a vacuum cleaner frame, which compartment is closed by a door or cover. These covered tool storage arrangements greatly increase the overall size of the vacuum cleaner frame thus reducing the portability and ease of manipulation of the cleaner and, by increasing the size and complexity of the frame, they adversely influence its cost effectiveness.

U.S. Pat. No. 2,649,606, Aug. 25, 1953, of Fadner, discloses a vacuum cleaner in which a tool holder, which may be stored on the cleaner frame or separately therefrom, accommodates a variety of different tools exteriorly visible when the tool holder is fastened over the top of the cleaner frame. In this arrangement, the stored tools being exposed on the top of the cleaner are not only prone to disadvantageous accidental contact with furniture, drapes, and the like, but being arranged on upwardly facing surfaces of the cleaner frame, are unsightly and can collect dust and dirt.

OBJECTS OF THE INVENTION

It is an object of this invention to provide for tool storage on the frame of a vacuum cleaner in a cost effective uncovered manner without materially increasing the overall size of the cleaner frame. These objects of the invention are attained by providing tool accommodating cavities on the underside of the cleaner frame together with simple tool retaining keepers shiftably supported on the cleaner frame for detaining the tools substantially out of sight, each in a respective cavity beneath the cleaner frame.

DESCRIPTION OF THE DRAWINGS

With the above and additional objects and advantages in view, as will hereinafter appear, this invention will now be described with reference to the accompanying drawings of a preferred embodiment in which.

Figure 1:
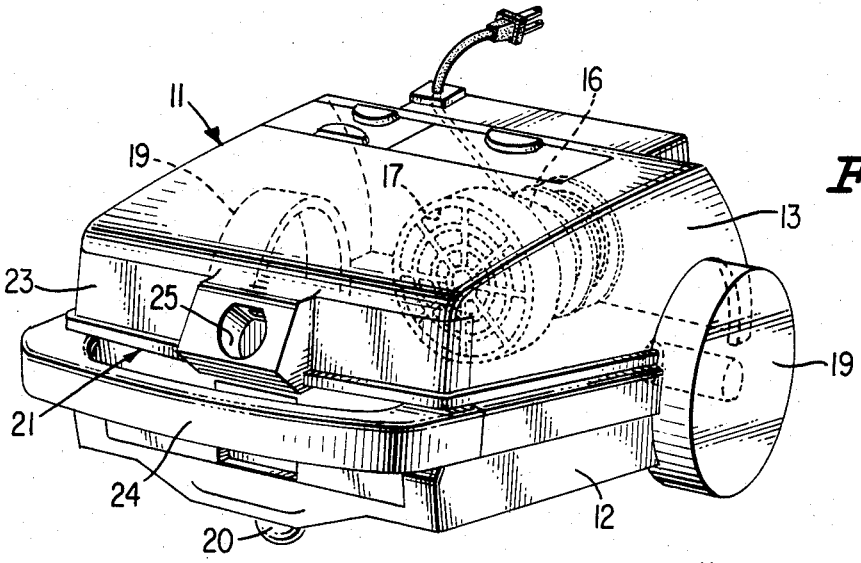
FIG. 1 is a top perspective view of a canister type vacuum cleaner of a type to which this invention is advantageously applicable.
Figure 2:
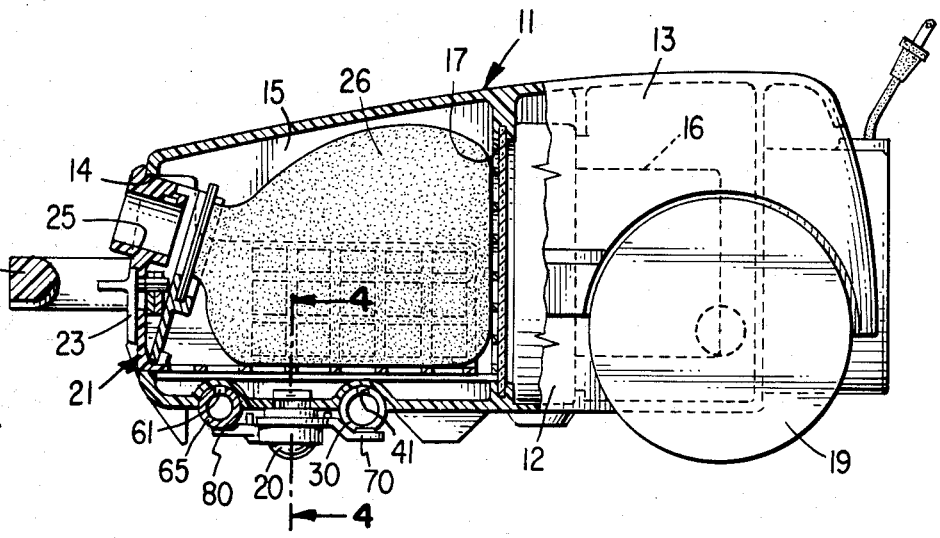
FIG. 2 is an elevational view of the vacuum cleaner of FIG. 1 with portions illustrated in vertical cross section.

Illustrated in FIGS. 1 and 2 is a canister type vacuum cleaner indicated generally at 11 having a housing including a base portion 12 and a cover 13. An opening 14 in the cleaner housing 12, 13, communicates with a vacuum chamber 15 from which air is evacuated by a motor blower unit 16 through an air outlet 17 therein.

The vacuum cleaner is floor supported on a pair of wheels 19—19 and a spherical roller 20, and the housing opening 14 is closed by the front wall 23 of a tray indicated generally at 21. A handle 24 on the tray 21 is provided for manipulating and carrying the vacuum cleaner when the tray is latched in place in the cleaner housing.

An access opening 25 through the front wall 23 of the tray 21 provides for communication of a flexible hose (not shown) through the tray front wall and to the interior of a disposable filter bag 26 carried on the tray 21.

Cleaning tools, or attachments, to the storage of which this invention is directed, are adapted to be secured to the free extremity of a flexible hose communicating with the access opening 25 so that the vacuum created by the motor blower unit 16 will result in a flow of air into the cleaning attachments, through the flexible hose and onto and through the walls of the disposable filter bag 26 within the vacuum chamber 15 of the cleaner housing.

Figure 5:
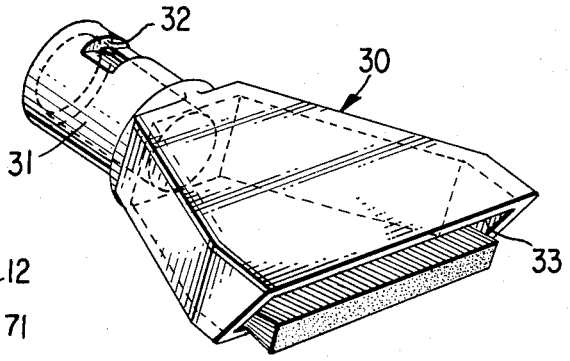
FIG. 5 is a perspective view of a vacuum cleaner tool of the type adapted to be stored in accordance with this invention.

While any known conventional hose connection to the vacuum cleaner and to cleaning attachments may be employed, FIG. 5 illustrates a typical cleaning attachment indicated generally at 30 and including a cylindrical butt 31 formed with a latch accommodating aperture 32. For a complete description of a preferable hose connection to such attachment, reference may be had to copending U.S. patent application Ser. No. 912,746, filed Sept. 29, 1986, now U.S. Pat. No. 4,669,755, issued June 2, 1987.

Figure 3:
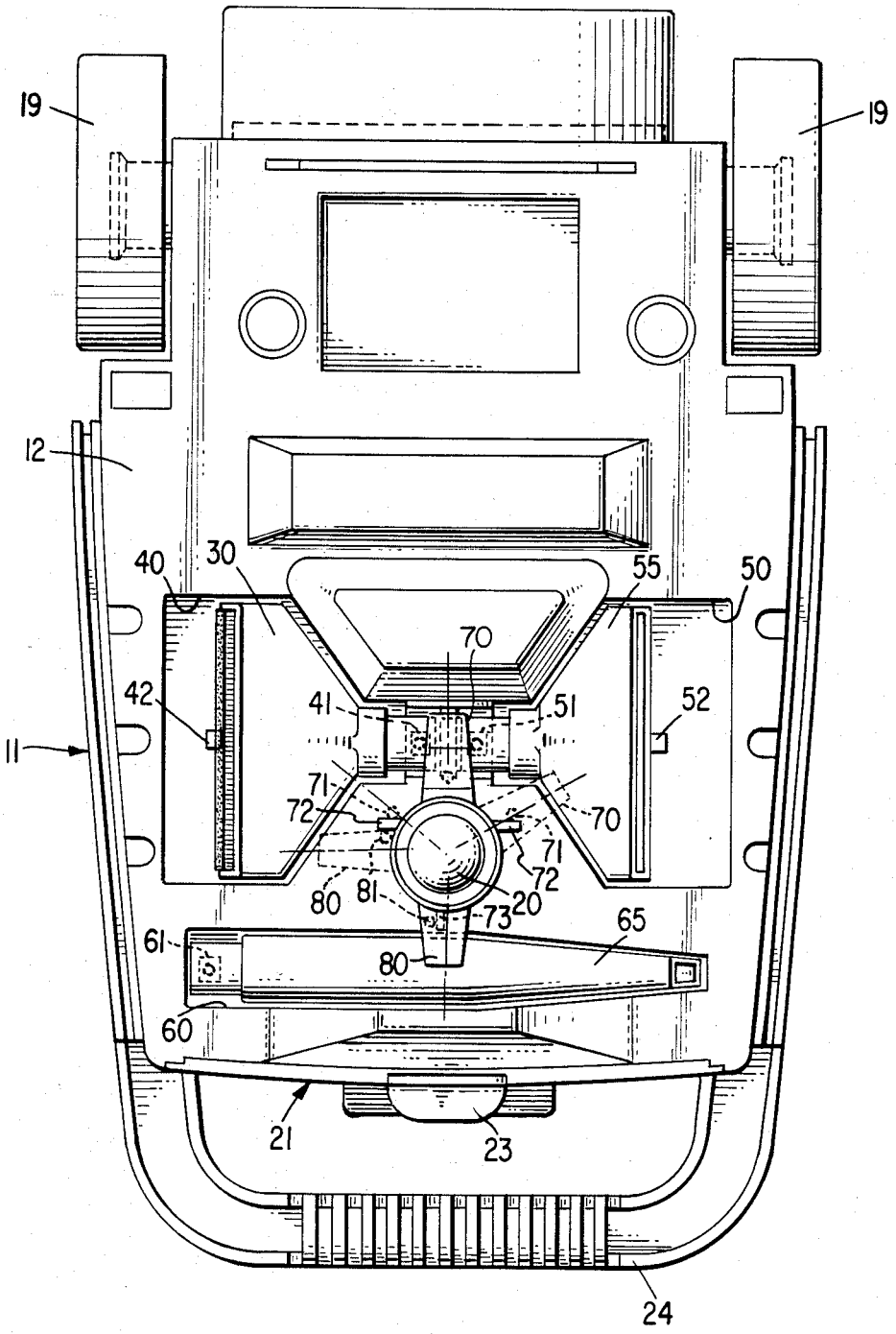
FIG. 3 is a bottom plan view of the vacuum cleaner of FIGS. 1 and 2.

As best illustrated in FIGS. 2 and 3, the cleaner attachments, in accordance with this invention are stored beneath the vacuum cleaner housing in recesses 40, 50 and 60 formed upwardly into the base portion 12 of the cleaner housing. Each of the recesses 40, 50 and 60 is shaped to conform to the outline of a particular cleaning attachment intended to be stored therein and, preferably, the recesses each have a depth of at least one half of the cleaning attachment thickness. Recess 40 is intended to accommodate the cleaning attachment 30 illustrated in FIG. 5, and the cleaning attachment 30 is shown in the recess 40 in FIG. 3. Projections 41 and 42 from the floor of the recess 40 are adapted to cradle the cleaning attachment, projection 41 being located and shaped to extend into the latch accommodating aperture 32 of the cleaning attachment and projection 42 being located and shaped so as to abut the nozzle mouth 33 of the cleaning attachment. The projections 41 and 42 may be plain cylindrical in shape simply to locate the cleaning attachment in the recess; or the projections 41 and 42 may be bifurcated and formed with lateral lips at the extremity so as to resiliently engage the cleaning attachment in the recess.

Each of the other recesses 50 and 60 may be provided with projections 51, 52 and 61 of the same description and purpose as projections 41 and 42 and adapted to suit the particular cleaning attachments to be accommodated. As shown in FIG. 3, the recess 50 may accommodate a cleaning attachment 55 fitted without a brush; and recess 60 may accommodate a crevice cleaning attachment 65.

The principal agency for retaining the cleaning attachments in stored position within the recesses 40, 50 and 60 beneath the cleaner housing are latch levers 70 and 80 which are pivotally mounted on the cylindrical retainer 90 for the spherical roller 20.

Figure 4:
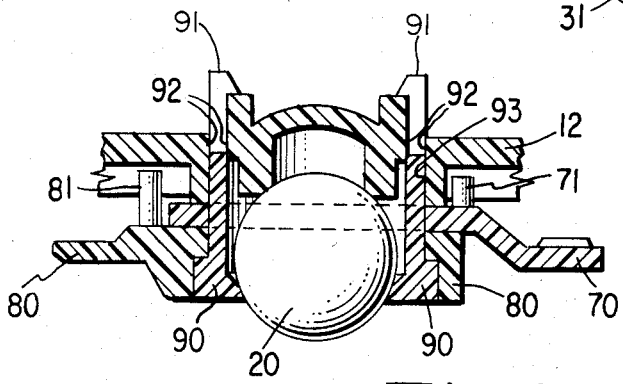
FIG. 4 is an enlarged cross sectional view of the spherical swivel support for the vacuum cleaner taken substantially along line 4—4 of FIG. 2.

As shown in FIG. 4, the spherical roller retainer 90 is formed with a pair of mounting lugs 91—91 which snap into notches 92—92 at opposite sides of a mounting aperture 93 for the spherical roller 20 beneath the cleaner housing base portion 12. Each of the latch levers 70 and 80 is formed with stop projections 71, 81, respectively.

A pair of stop abutments 72—72 are formed on the spherical roller retainer 90 for cooperation with the stop projection 71 of the latch lever 70 limiting an extreme position of the latch lever 70 in each direction of rotation out of overlying relation to one or the other of the cleaning attachments 40 or 50. When the latch lever 70 is in any other position with the stop projection 71 out of engagement with either stop abutment, the latch lever 70 will underlie both of the cleaning attachments 30 and 55 and provide the principal agency for retention of both attachments in their respective storage recesses.

The stop projection 81 of the latch lever 80 for retaining the crevice cleaning attachment 65 in the recess 60 cooperates with a single stop abutment 73 on the spherical roller retainer 90 to identify a position of the latch lever 80 underlying the crevice cleaning attachment 65 to retain the attachment 65 in the recess 60.

As is illustrated in FIG. 1, attachments stored beneath the cleaner housing are not visible when the vacuum cleaner is floor supported; and, therefore, a cover for the attachments is not necessary for aesthetic considerations. Moreover, the downward opening storage recesses for the attachments obviates dust and dirt accumulation therein thus eliminating another reason why a cover might be necessary.

The present invention thus provides a highly cost effective means for storing cleaner attachments in a manner readily available for use. It is understood that the above-described embodiment is merely illustrative of the application of the principles of this invention. Numerous other arrangements may be devised by those skilled in the art without departing from the spirit and scope of this invention, as defined by the appended claims.

We claim:

1. A vacuum cleaner having a housing enclosing a motor blower and dirt collecting means, and further having means thereon supporting said housing for movement across a floor or a like planar surface, said housing being formed with respect to said supporting means with a top, sides and a bottom surface, said vacuum cleaner being adapted for selective operation with a cleaner attachment chosen from among at least one cleaner attachment, and means for storing said at least one attachment during a period of non-use thereof, said storing means comprising:

at least one cleaner attachment accommodating recess formed in said housing extending upwardly into said bottom surface; and operator influenced latch means carried by said housing for selectively blocking movement of a cleaner attachment into or out of said attachment accommodating recess in said housing.

2. The vacuum cleaner as set forth in claim 1 in which said supporting means comprises a pair of coaxially arranged wheels and a floor engaging swivel journaled beneath said housing on an axis perpendicular to and spaced from the axis of said wheels, and in which said latch means includes a latch element pivotally supported about said swivel axis for selective positioning spanning at least a portion of said attachment accommodating recess.

3. The vacuum cleaner as set forth in claim 2 in which the bottom surface of said housing is formed with a plurality of cleaner attachment accommodating recesses, said recesses extending in adjacent sectors about said floor engaging swivel, each said recess having a configuration complemental to the other of a specific cleaner attachment, and a plurality of latch elements each pivotally supported about said swivel axis for selective positioning, each spanning a selected one of said plurality of attachment accommodating recesses.

* * * * *